US008905777B2

(12) United States Patent
Zhu et al.

(10) Patent No.: US 8,905,777 B2
(45) Date of Patent: Dec. 9, 2014

(54) ELECTRICAL CONNECTOR ASSEMBLY WITH AN IMPROVED LATCH MECHANISM

(71) Applicant: Hon Hai Precision Industry Co., Ltd., New Taipei (TW)

(72) Inventors: Jian-Jun Zhu, Kunshan (CN); Qing-Man Zhu, Kunshan (CN); Chien-Chiung Wang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 30 days.

(21) Appl. No.: 13/872,164

(22) Filed: Apr. 29, 2013

(65) Prior Publication Data

US 2013/0288507 A1 Oct. 31, 2013

(30) Foreign Application Priority Data

Apr. 28, 2012 (CN) ..... 2012 1 0129567

(51) Int. Cl.
*H01R 13/627* (2006.01)

(52) U.S. Cl.
USPC ..... 439/352; 439/358

(58) Field of Classification Search
USPC ..... 439/352, 357, 358
See application file for complete search history.

(56) References Cited

U.S. PATENT DOCUMENTS

| | | | | |
|---|---|---|---|---|
| 6,824,416 | B2 | 11/2004 | Di Mascio | |
| 7,160,135 | B1 * | 1/2007 | Wu | 439/352 |
| 7,238,040 | B1 * | 7/2007 | Wu | 439/352 |
| 7,281,937 | B2 * | 10/2007 | Reed et al. | 439/352 |
| 7,540,755 | B1 * | 6/2009 | Wu | 439/352 |
| 2012/0164860 | A1 | 6/2012 | Wang et al. | |

* cited by examiner

*Primary Examiner* — Hien Vu
(74) *Attorney, Agent, or Firm* — Wei Te Chung; Ming Chieh Chang

(57) ABSTRACT

An electrical connector assembly (100) including a housing (1) having a channel (12) formed on a top surface thereof and extending along a mating direction, a latch mechanism (6) received in the channel and being capable of sliding in the channel, and a spring (8) received in the indentation. An indentation (1216) is formed in the channel. The spring is limited by the latch mechanism along a front to rear direction. The latch mechanism defines a block (6202) extending into the indentation and attached to a front end of the spring.

12 Claims, 9 Drawing Sheets

ELECTRICAL CONNECTOR ASSEMBLY WITH AN IMPROVED LATCH MECHANISM

FIELD OF THE INVENTION

The present invention generally relates to connectors suitable for transmitting data, more specifically to input/output (I/O) connectors with high-density configuration and high data transmitting rate.

DESCRIPTION OF PRIOR ART

U.S. Patent Publication No. 20120164860A1 to Chien-Chiung Wang et al. published on Jun. 28, 2012 discloses a plug connector latched with a complementary connector. The plug connector comprises a housing and a latch mechanism mounted on the housing, and the complementary connector defines a latching tab having a latching hole, the housing defines a latching nose for latching with the latching tab. The plug connector has a protrusion promoted by the latch mechanism and actuating the latching tab disengaging from the latching nose. However the plug connector has a complex structure with much components.

An electrical connector assembly having an improved latch mechanism is desired.

SUMMARY OF THE INVENTION

Accordingly, an object of the present invention is to provide an electrical connector assembly with an improved latch mechanism.

In order to achieve the above-mentioned objects, an electrical connector assembly comprises: a housing having a channel formed on a top surface thereof and extending along a mating direction, a latch mechanism received in the channel and being capable of sliding in the channel, and a spring received in the indentation. An indentation is formed in the channel. The spring is limited by the latch mechanism along a front to rear direction. The latch mechanism defines a block extending into the indentation and attached to a front end of the spring.

Other objects, features and advantages of the invention will be apparent from the following detailed description taken in connection with the accompanying drawings.

DETAILED DESCRIPTION OF PREFERRED EMBODIMENTS

Figure 1:
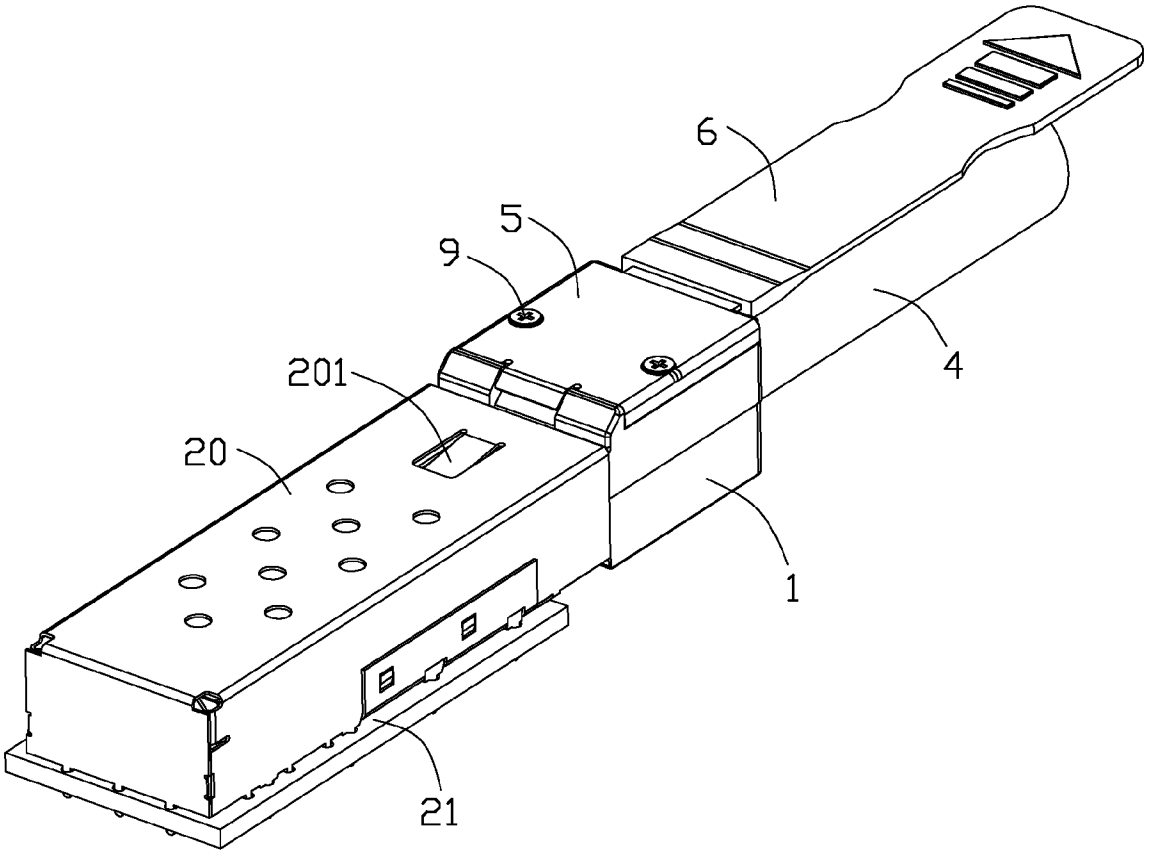
FIG. 1 is an assembled perspective view of an electrical connector assembly in accordance with the present invention and a receptacle connector mated with each other.

Reference will now be made to the drawing figures to describe the present invention in detail.

FIGS. 1 to 9 illustrate perspective views of an electrical connector assembly 100 made in accordance with the present invention, and the electrical connector assembly 100 is capable of latching with a receptacle connector 200 along a mating direction. The receptacle connector 200 comprises a metallic shell or cage 20 having a latching tab 201 extending towards an interior room thereof. The electrical connector assembly 100 comprises an elongated housing 1 having a receiving room 10 therein, a printed circuit board (PCB) 3 positioned in the receiving room 10, a latch mechanism 6 mounted on an exterior surface of the housing 1, a shielding member 5 assembled to the housing 1 and shielding the latch mechanism 6, and a cable 4 electrically connected with the printed circuit board 3.

Figure 2:
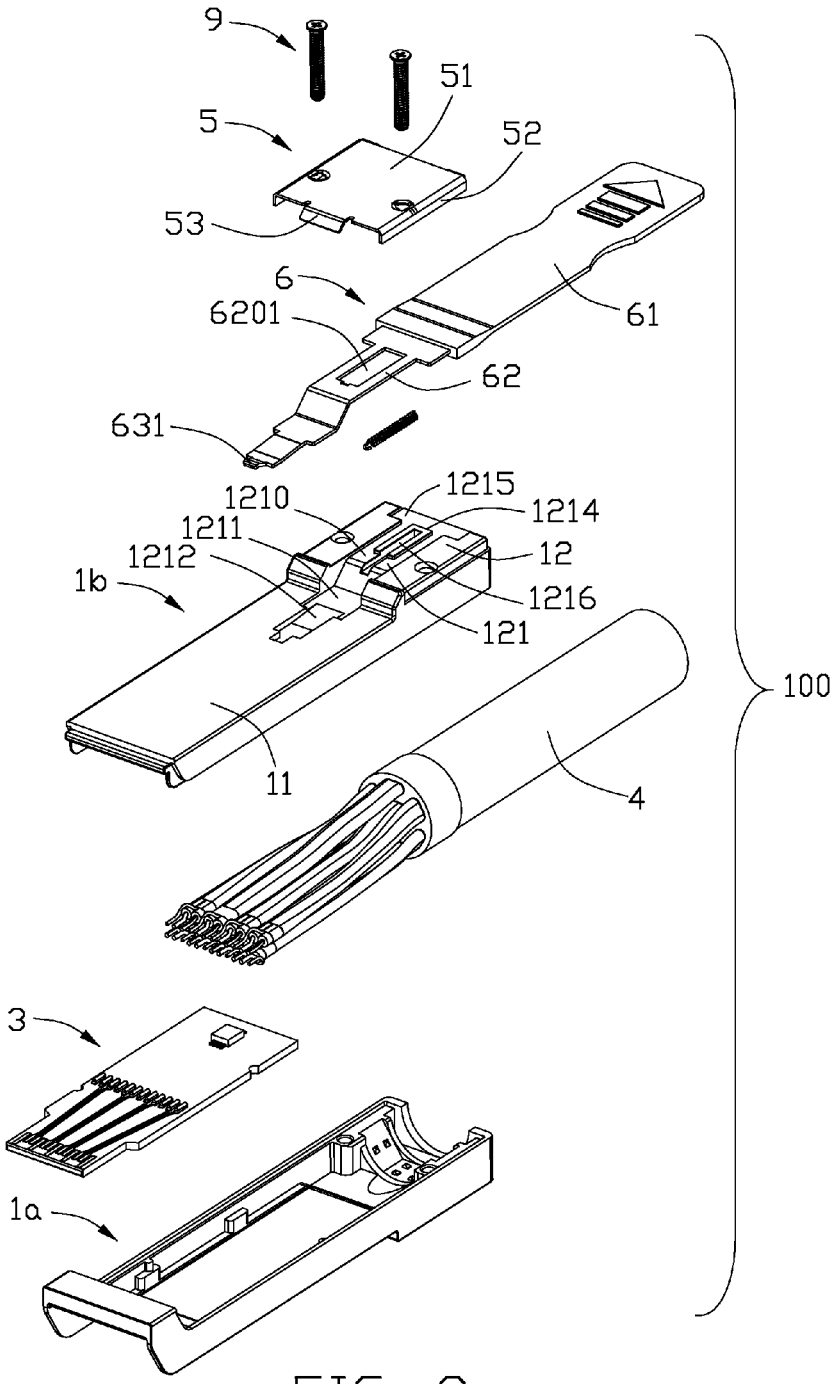
FIG. 2 is an exploded, perspective view of the electrical connector assembly of FIG. 1.
Figure 3:
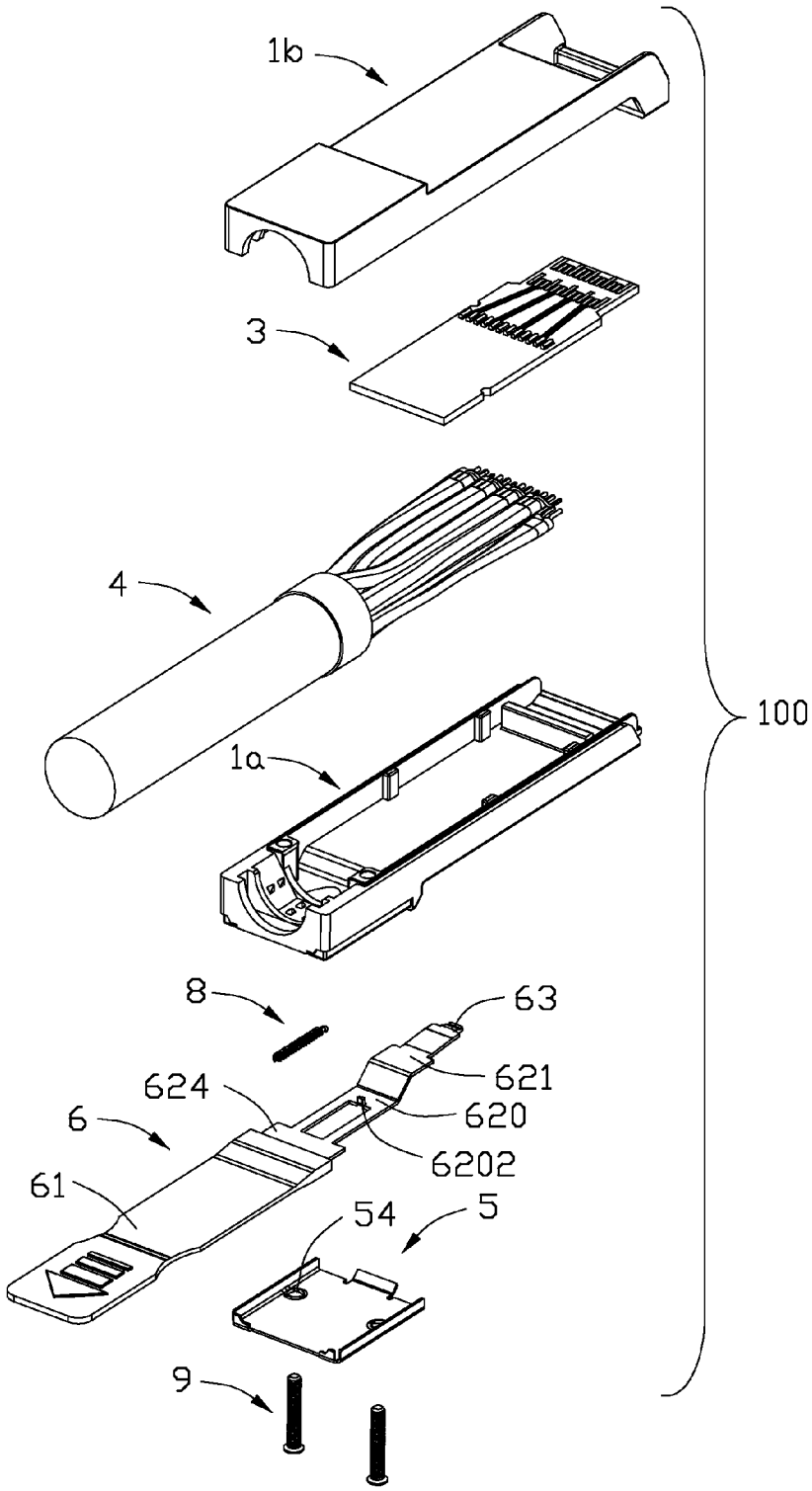
FIG. 3 is another perspective view of the electrical connector assembly of FIG. 2.
Figure 6:
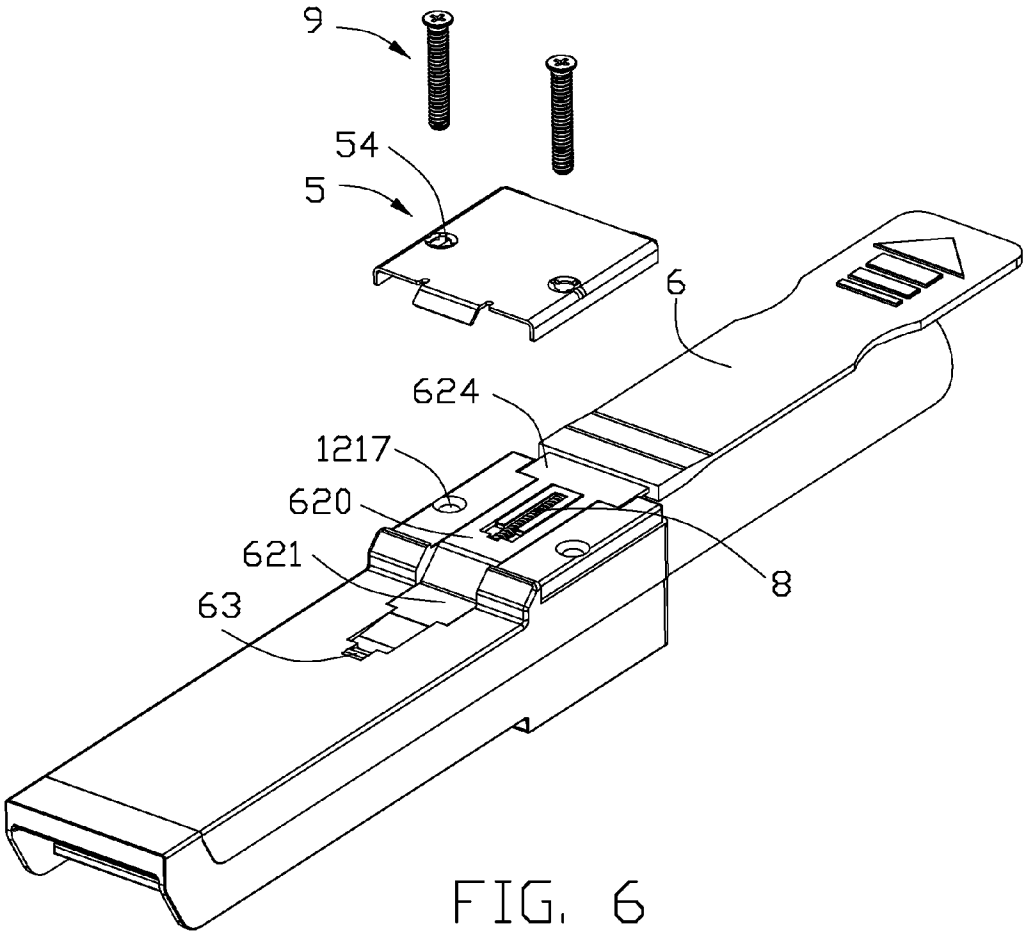
FIG. 6 is a partially assembled, perspective view of the electrical connector assembly of FIG. 2.
Figure 7:
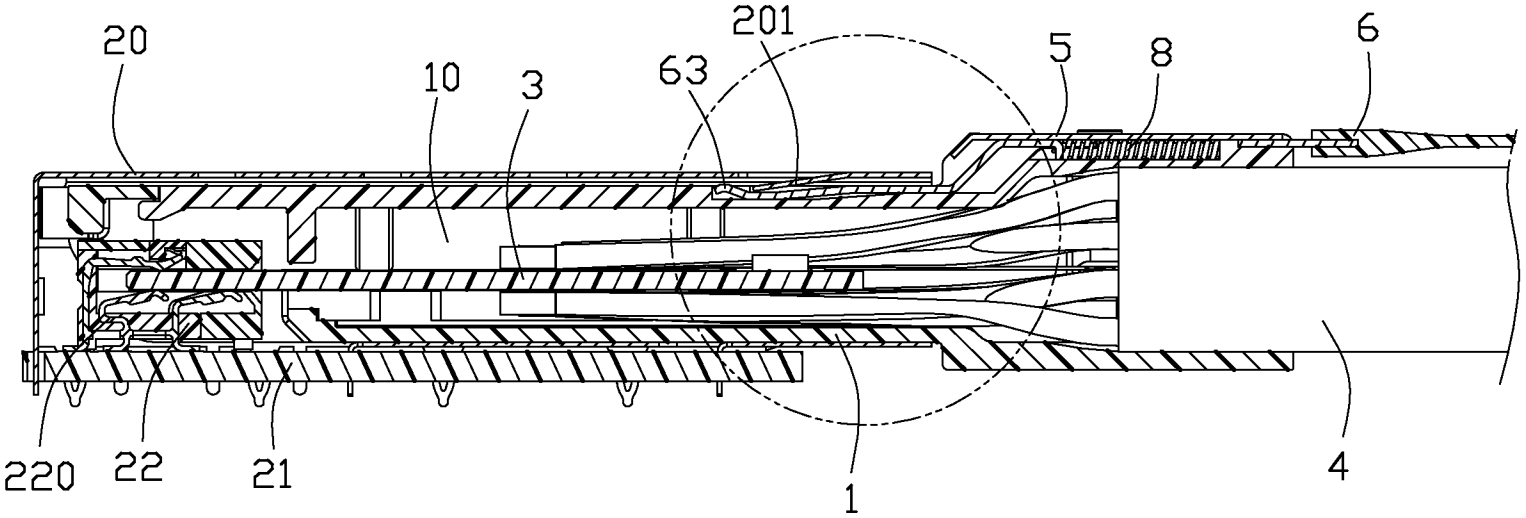
FIG. 7 is a partial cross section view of the electrical connector assembly of FIG. 1 taken along line 7-7.
Figure 8:
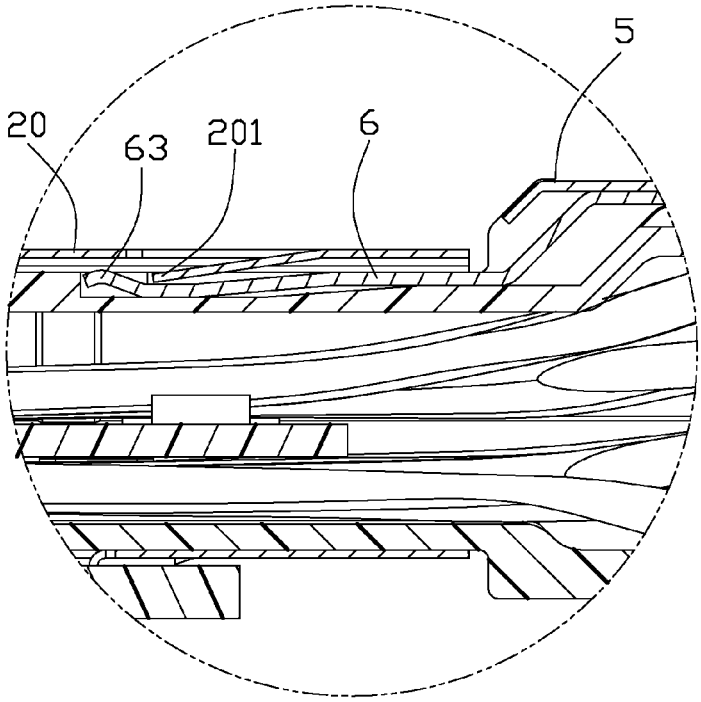
FIG. 8 is an enlarged cross-sectional view showing a cooperation of a latching tab of the receptacle connector and the electrical connector assembly.
Figure 9:
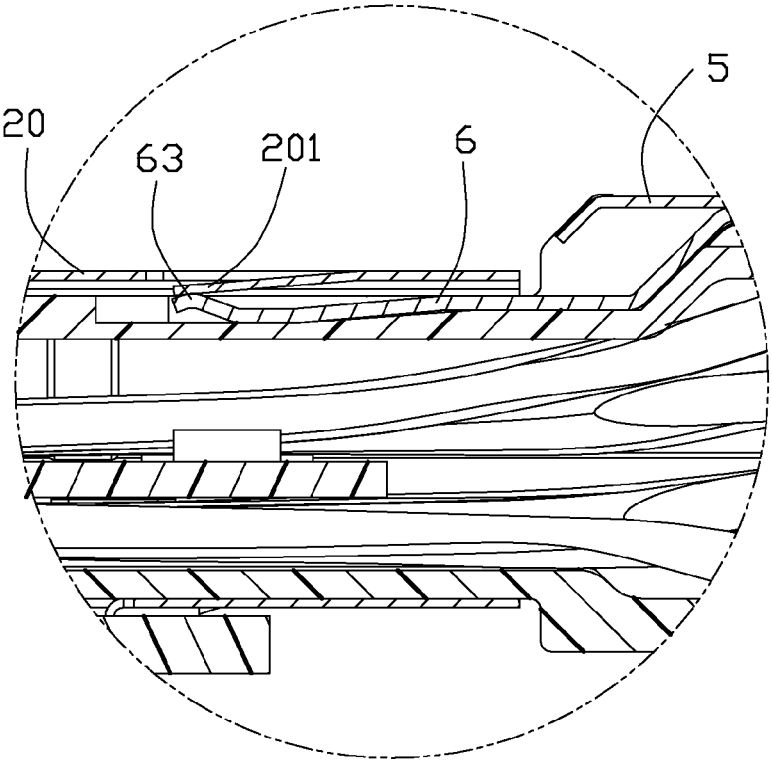
FIG. 9 is a view similar to FIG. 8, when the latch mechanism is situated in a released position.

Referring to FIGS. 2 to 3, and in conjunction with FIG. 6, the housing 1 is made of metallic material and formed in a die-cast manner. The housing 1 comprises a first shield part 1*a* and a second shield part 1*b* assembled with each other along a vertical direction. The receiving room 10 is commonly formed by the first and second shield parts 1*a*, 1*b*.

The second shield part 1*b* defines a top surface comprising a first surface 11 and a second surface 12. The first surface 11 is located below and disposed in front of the second surface 12. A pair of screw holes 1217 are recessed on two lateral sides of the second shield part 1*b* and throughout the second shield part 1*b* along a vertical direction. The second shield part 1*b* defines a channel 121 extending from the second surface 12 to the first surface 11 along a rear to front direction and with different widths. The channel 121 comprises a receiving slot 1210 on the second surface 12, a positioning slot 1215 located behind and communicated with the receiving slot 1210, an extension slot 1211 extending forwards from the receiving slot 1210, a fixing slot 1212 extending forwards from the extension slot 1211. The fixing slot 1212 has a depth becoming deeper and deeper from a rear-to-front direction, and includes a front narrow section and a back wide section. A protrusion 1214 is disposed in the receiving slot 1210, and an indentation 1216 is defined in the protrusion 1214, the indentation 1216 is extending forwards and communicated with the extension slot 1211. The extension slot 1211 has a width wider than that of the receiving slot 1210.

The latch mechanism 6 comprises a pull tape 61 formed on a rear end thereof, an actuator 63 formed on a front end thereof, and a connecting portion 62 extending between the pull tape 61 and the actuator 63. The latch mechanism 6 is mounted on the housing 1, and the pull tape 61 extends beyond a rear end of the housing 1. The connecting portion 62 comprises a horizontal main portion 620, a limiting portion 624 located behind the main portion 620 and connected with the pull tape 61, a resisting portion 621 extending forwards and bent downwards from the main portion 620. The actuator 63 is structured in a curved shape and extending forwards from the resisting portion 621. An opening 6201 is defined on the main portion 620, and a block 6202 is defined on a front end of the opening 6201 and extending downwards. The main portion 620 is accommodated in the receiving slot 1210, and the resisting portion 621 is received in the extension slot 1211, the actuator 63 is disposed in the fixing slot 1212 and having a free end 631 coplanar with the first surface 11. The protrusion 1214 is inserted into the opening 6201, and the protrusion 1214 is capable of sliding in the opening 6201 along the front-to-back direction, the block 6202 is extending into the indentation 1216.

A spring 8 is received in the indentation 1216, with a front end thereof attached to the block 6202 of the latch mechanism 6, and a rear end attached to a back wall of the indentation 1216. As exerting a pulling force to the pull tape 61, the block 6202 in the opening 6201 is compressing the spring 8 moving rearwards. As releasing the pull tape 61, the spring 8 can promote the latch mechanism 6 in an original position by a restoring force of the spring 8.

The shielding member 5 comprises a top wall 51, a pair of lateral walls 52 extending downwards from both sides of the top wall 51, and a rear wall 53 extending downwards from a back end of the top wall 51. A pair of screw holes 1217 is defined on the second surface 12 of the housing 1. A pair of fixing holes 54 is defined on the top wall 51 and aligning with the corresponding screw holes 1217, a pair of screw pins 9 are inserted into the fixing holes 54 and the screw holes 1217, thus the shielding member 5 is fastened to the housing 1.

Figure 4:
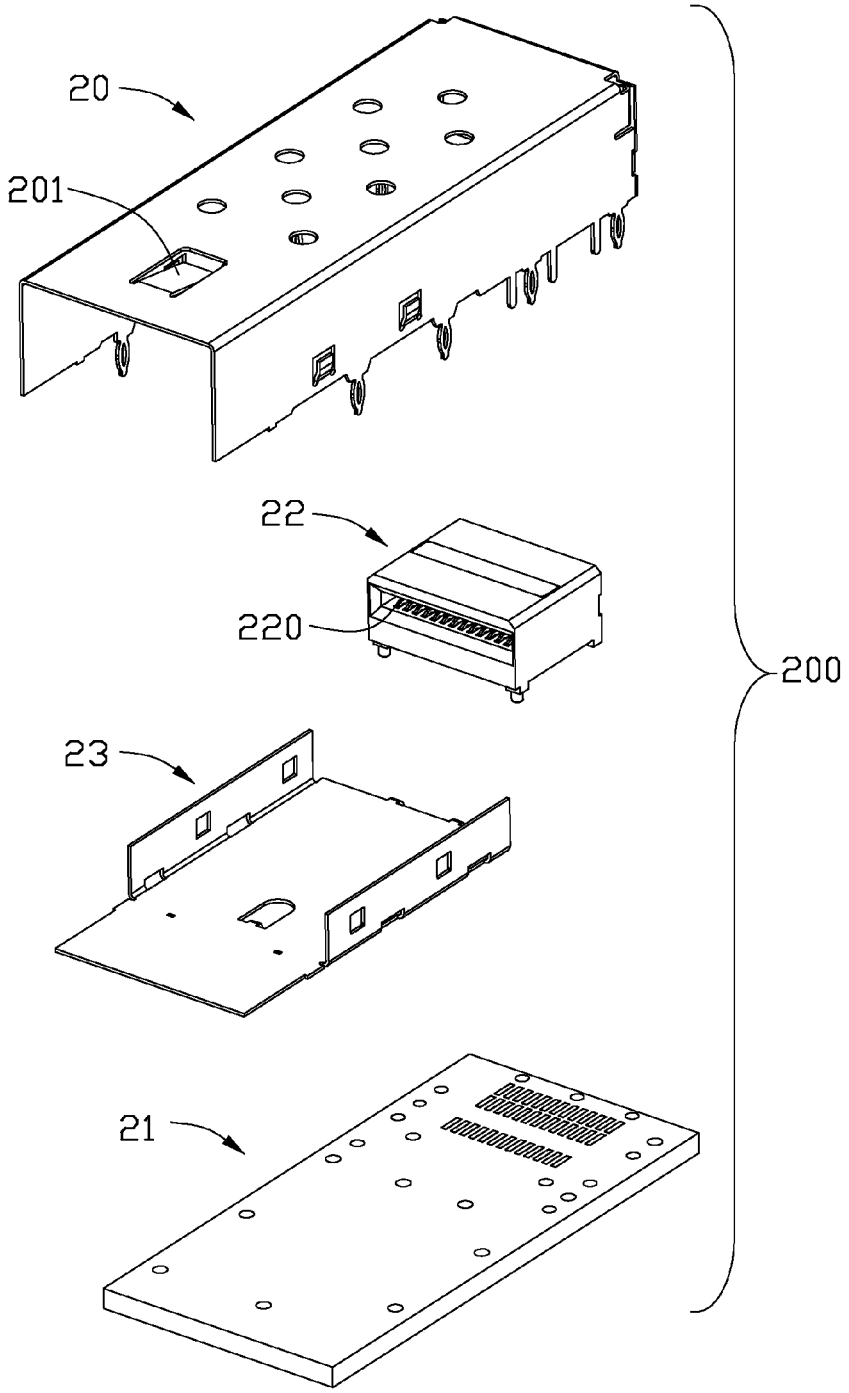
FIG. 4 is an exploded, perspective view of the receptacle connector shown in FIG. 1.
Figure 5:
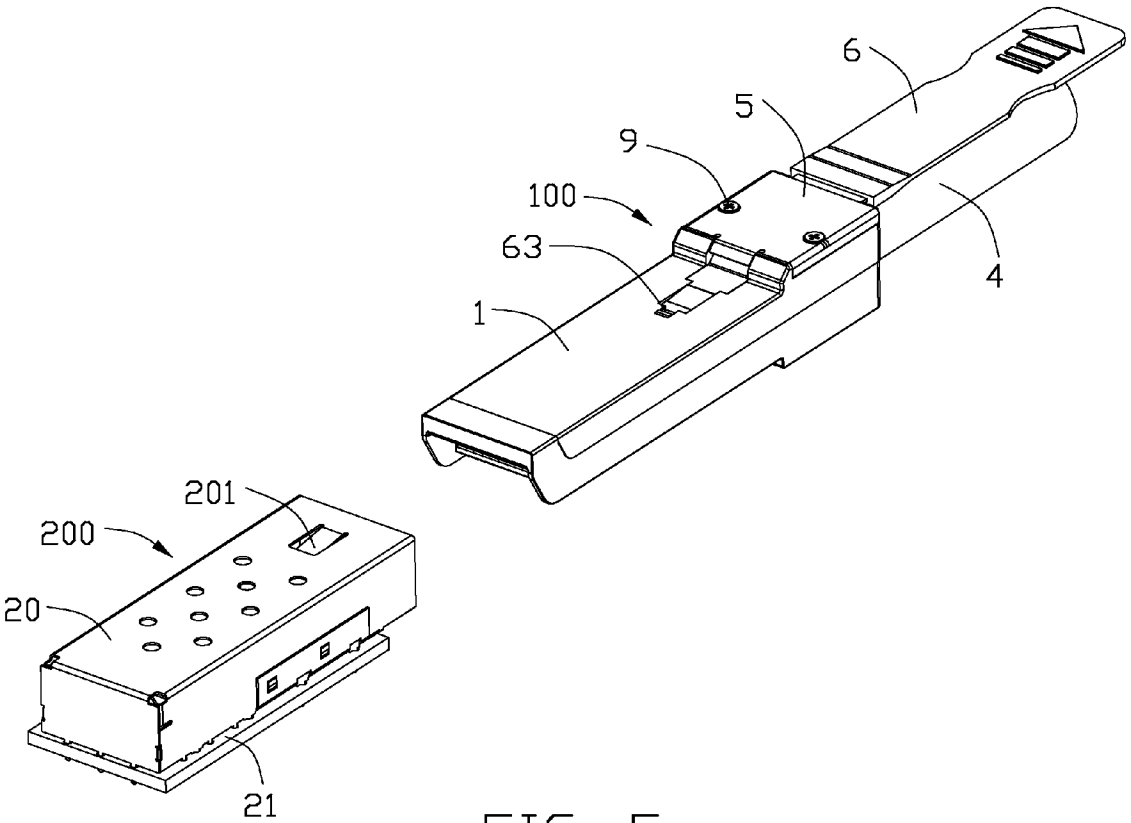
FIG. 5 is a perspective view of the electrical connector assembly and the receptacle connector shown in FIG. 1 separated with each other.

Referring to FIGS. 4-5, the latching tab 201 of the receptacle connector 200 is stamped by partial segment of the metallic shell 20. In further, the receptacle connector 200 has an engaging shell 23 cooperated with the metallic shell 20, an insulated housing 22 received in the metallic shell 20, and a printed circuit board 21 connected to and located below the metallic shell 20. A plurality of contacts 220 are held in the insulated housing 22 and electrically connected with the printed circuit board 21.

Referring to FIGS. 5 to 9, when the electrical connector assembly 100 mating the receptacle connector 200, the printed circuit board 3 of the electrical connector assembly 100 is connected with contacts 220 of the receptacle connector 200. The latching tab 201 of the receptacle connector 200 is locked in the fixing slot 1212 of the housing 1 and located behind the actuator 63, for preventing the electrical connector assembly 100 disengage from the receptacle connector 200. When the electrical connector assembly 100 disengaging away from the receptacle connector 200, just exert a pulling force on the pull tape 61 to promote the block 6202 moving rearwardly, the spring 8 is pressed, thus the actuator 63 is moving backwards along the fixing slot 1212 and the latching tab 201 can be raised up by the actuator 63, then the latching tab 201 can be disengaged from the electrical connector assembly 100, and the electrical connector assembly 100 is depart from the receptacle connector 200. When releasing the pull tape 61, the spring 8 can promote the actuator 63 and the pull tape 61 being reset.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a housing having a channel formed on a top surface thereof and extending along a mating direction, and an indentation formed in the channel;

a latch mechanism received in the channel, and being capable of sliding in the channel; and a coil spring received in the indentation and limited by the latch mechanism moving along a front to rear direction;

wherein the latch mechanism defines a block extending into the indentation and attached to a front end of the coil spring;

wherein the latch mechanism comprises a pull tape on a back end thereof, an actuator on a front end, and a connecting portion located between the pull tape and the actuator;

wherein the channel comprises a receiving slot, and the indentation is defined in the receiving slot;

wherein the actuator has a free end structured in a curved shape and disposed in a fixing slot of the channel, and wherein the housing comprises a first surface and a second surface, and the first surface is located below and disposed in front of the second surface, the channel is extending from the second surface to the first surface.

2. The electrical connector assembly as recited in claim 1, wherein a protrusion is disposed in the receiving slot, and an opening is defined on the connecting portion, the protrusion is inserted into the opening.

3. The electrical connector assembly as recited in claim 2, wherein a rear end of the spring is attached to a back wall of the indentation.

4. The electrical connector assembly as recited in claim 1, wherein the receiving slot is defined on the second surface, and the channel further comprises a positioning slot located behind and communicated with the receiving slot, an extension slot extending forwards from the receiving slot and connected the second surface and the first surface.

5. The electrical connector assembly as recited in claim 1, further comprising a printed circuit board received in the housing and a cable electrically connected with the printed circuit board.

6. The electrical connector assembly as recited in claim 1, further comprising a shielding member assembled to the housing and shielding on the latch mechanism.

7. An electrical connector assembly for mating with a complementary connector, comprising:

a housing having a channel formed on a top surface and extending along a mating direction;

a latch mechanism received in the channel, and capable of sliding in the channel; and a coil spring received in the channel and limited by the latch mechanism moving along a front to rear direction;

wherein the complementary connector defines a latching tab locked in the channel, the coil spring is compressed by a pulling force exerted to the latch mechanism rearwards, and the latching tab of the complementary connector is raised up by the mechanism, to promote the electrical connector assembly to depart from the complementary connector, and the spring can promote the latch mechanism reset when releasing the mechanism;

wherein the latch mechanism comprises a pull tape on a back end thereof, an actuator on a front end, and a connecting portion located between the pull tape and the actuator;

wherein the actuator is structured in a curved shape and disposed in a fixing slot of the channel, and the latching tab is locked in the fixing slot and located behind the actuator; and wherein the housing comprises a first surface and a second surface, and the first surface is located below and disposed in front of the second surface, the channel is extending from the second surface to the first surface.

8. An electrical connector assembly comprising:

a housing adapted to be removably received in a metallic cage and defining two opposite large horizontal walls and two opposite small vertical side walls, an exterior surface of one of said main horizontal walls defining therein a channel extending along a front-to-back direction, a fixing slot formed around said exterior surface and in front of said channel for latchable engagement with a latching tab of the metallic cage;

a latch mechanism back and forth moveable relative to the housing along the front-to-back direction, and defining an actuator at a front end region located around the fixing slot, a pull tape at a rear region exposed to an exterior for grasping, and a connecting portion located between said actuator and said pull tape, and received in the channel; and a coil spring located upon said one of said main horizontal walls and communicatively overlapped with the channel in a top view;

wherein along the front-to-back direction, one end region of the spring is fixed to the latch mechanism and back and forth moveable along with the latch mechanism synchronically in the front-to-back direction, and the other end region of the spring abuts against the housing in a stationary manner so as to bring about a restoration force when said latch mechanism is backward moved; and wherein said connecting portion defines a block to which the end region of the coil spring is fixed.

9. The electrical connector assembly as claimed in claim 8, wherein an indentation is formed in the housing and communicatively around the channel to receive said spring therein.

10. The electrical connector assembly as claimed in claim 8, wherein a shielding member is attached to said exterior surface and cooperates with the housing to sandwich said connecting portion therebetween in a vertical direction perpendicular to said front-to-back direction.

11. The electrical connector assembly as claimed in claim 10, wherein said spring is located between the shielding member and said housing in the vertical direction.

12. The electrical connector assembly as claimed in claim 8, wherein said connecting portion and said actuator are located at different levels in a vertical direction perpendicular to said front-to-back direction.

* * * * *